US005823349A

United States Patent [19]

Bridges

[11] Patent Number: 5,823,349

[45] Date of Patent: Oct. 20, 1998

[54] SECURING A CORRUGATED CONTAINER TO A PALLET

[75] Inventor: John W. Bridges, Pflugerville, Tex.

[73] Assignee: Dell USA, L.P., Round Rock, Tex.

[21] Appl. No.: 850,835

[22] Filed: May 2, 1997

[51] Int. Cl.[6] ..... B65D 19/00

[52] U.S. Cl. ..... 206/597; 206/386

[58] Field of Search ..... 206/386, 597, 206/600; 217/66; 108/51.11, 55.1, 55.5

[56] References Cited

U.S. PATENT DOCUMENTS

| | | | |
|---|---|---|---|
| 2,730,287 | 1/1956 | Mueller . | |
| 3,443,737 | 5/1969 | Kupersmit . | |
| 3,719,342 | 3/1973 | Kupersmit . | |
| 3,954,219 | 5/1976 | Mangini et al. | 206/386 |
| 4,019,635 | 4/1977 | Boots | 108/55.1 |
| 4,445,614 | 5/1984 | Mitsumori et al. | 206/600 |
| 4,832,256 | 5/1989 | Grigsby | 229/23 |
| 5,029,734 | 7/1991 | Nichols | 206/600 |
| 5,069,338 | 12/1991 | Grigsby | 206/319 |
| 5,297,680 | 3/1994 | Butterfield et al. | 206/499 |
| 5,549,341 | 8/1996 | Chase et al. | 294/68.1 |

*Primary Examiner*—David T. Fidei
*Attorney, Agent, or Firm*—Skjerven, Morrill, MacPherson, Franklin & Friel, L.L.P.

[57] ABSTRACT

The present invention solves the problem of securing a corrugated shipping box to a skid or pallet without potential for injury when opened and which can be easily and securely resealed. The container for packaging and shipping articles of the present invention includes a substantially rectangular wooden base, such as a shipping skid or pallet, and a corrugated box. The box telescopes over the base wherein a portion of the base is inside the box. A reinforcing material, such as, for example, a foam plastic or Masonite®, is applied to a section of the outside walls of the corrugated box adjacent to the base. A plurality-of screws fasten the box to the base through the reinforcing material, wherein the reinforcing material provides reinforcement and strength to the bond between the screws, the box and the base.

12 Claims, 2 Drawing Sheets

SECURING A CORRUGATED CONTAINER TO A PALLET

BACKGROUND OF THE INVENTION

1. Field of the Invention

This invention relates to packaging and shipping containers and, more particularly, to securing shipping cartons to skids or pallets.

2. Description of the Related Art

A common design for shipping containers 90 for large items is a half slotted carton or box 100 and shipping skid 110 or pallet combination as illustrated in FIG. 1 (labeled prior art). The box 100 is typically manufactured of conventional corrugated paper. The bottom of the box 100 fits around a wood frame 120 on the skid 110, which is also typically wooden, to lock the box 100 in place on the skid 110. The box 100 is then usually secured to skid 110 using banding materials, such as metal or plastic bands 130, as illustrated in FIG. 2 (labeled prior art).

Although providing a strong and secure shipping container 90, use of the banding materials presents a number of disadvantages in the handling process especially when the shipped item reaches the customer. For example, to open the shipping container 90 the customer has to cut the metal or plastic bands 130 potentially causing injury to the customer if not carefully done. Another drawback in the use of banding materials is that, once the bands 130 are cut, the customer can not use the bands 130 to reseal the shipping container 90 to ship back for return or warranty repair purposes. The customer would usually resort to the use of shipping tape to reseal the shipping container 90. However, the shipping tape on the shipping container 90 usually cannot withstand the shipping environment and becomes dislodged or the shipping tape adheres improperly to the wood surface of the skid 110.

Therefore, an improved method for securing a shipping carton to a shipping skid or pallet is needed which provides a shipping container assembly that can be easily opened without potential for injury and can be easily and securely resealed.

SUMMARY OF THE INVENTION

The present invention solves the problem of securing a corrugated shipping box to a skid or pallet without potential for injury when opened and which can be easily and securely resealed. The container for packaging and shipping articles of the present invention includes a substantially rectangular wooden base, such as a shipping skid or pallet, and a corrugated box. The box telescopes over the base wherein a portion of the base is inside the box. A reinforcing material, such as, for example, a foam plastic or Masonite®, is applied to a section of the outside walls of the corrugated box adjacent to the base. A plurality of screws fasten the box to the base through the reinforcing material, wherein the reinforcing material provides reinforcement and strength to the bond between the screws, the box and the base.

BRIEF DESCRIPTION OF THE DRAWINGS

The present invention may be better understood, and its numerous objects, features, and advantages made apparent to those skilled in the art by referencing the accompanying drawings, FIG. 1 (labeled prior art) is an exploded perspective view of a shipping container including a half slotted carton, wooden frame and shipping skid.

The use of the same reference symbols in different drawings indicates similar or identical items.

DESCRIPTION OF THE PREFERRED EMBODIMENT(S)

Figure 1:
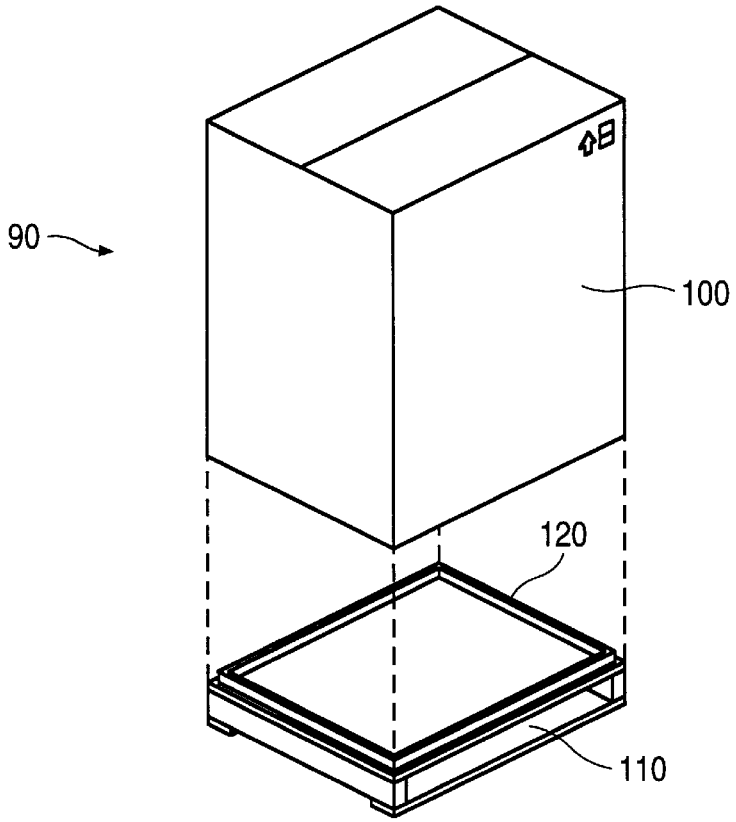
FIG. 1 (PRIOR ART)
Figure 2:
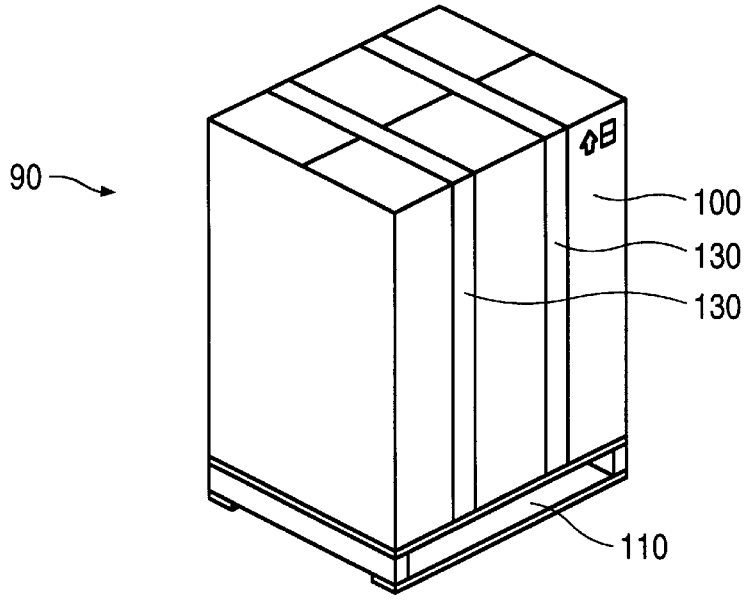
FIG. 2 (PRIOR ART)
FIG. 2 (labeled prior art) is a perspective view of the shipping container of FIG. 1 secured with banding materials.
Figure 3:
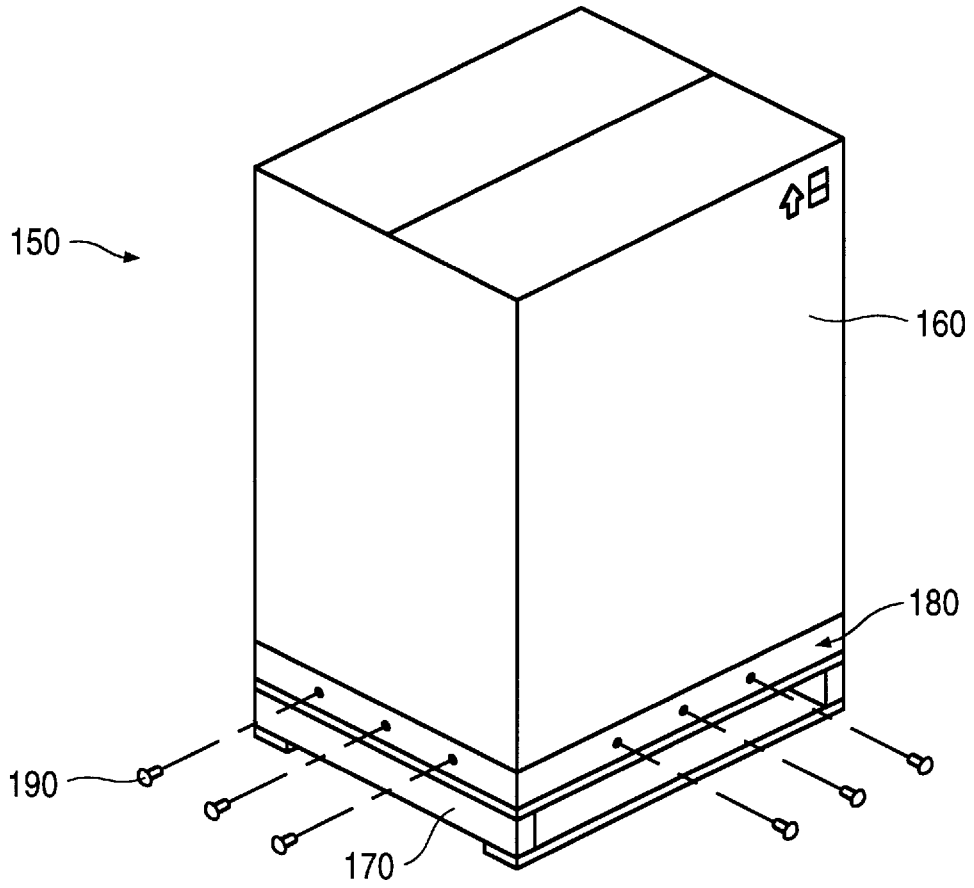
FIG. 3 is a perspective view of a shipping container secured in accordance with the present invention.

Referring now to FIG. 3, a container 150 and method for securing the container 150 for packaging and shipping articles is illustrated. The container 150 of the present invention includes a substantially rectangular wooden base 170, such as a shipping skid or pallet, which supports the article therein, and a corrugated box 160, such as, for example, a half slotted carton, which gives the container 150 definition. The box 160 telescopes over the base 170 wherein a portion of the base 170, such as, for example, the wooden frame 120 shown in FIG. 1, is inside the box 160 to lock the box 160 in place on the base 170.

A reinforcing material 180, such as, a foam plastic or Masonite®, is applied to a section of the outside walls of the corrugated box 160 adjacent to the base 170. Masonite® is manufactured from steam exploded wood fiber. The reinforcing material 180, is applied, for example, approximately ⅛ inch thick with a hot melt glue to the corrugated box 160. The hot melt glue enters the fibers of both the box 160 and the Masonite® to form a secure bond between the box 160 and the Masonite™. The reinforcing material 180 is, preferably, applied before the box 160 is placed on the base 170.

A plurality of screws 190, such as, for example, self-tapping wood screws, fasten the box 160 to the base 170 through the reinforcing material 180. The box 160 is attached to the base 170 by fastening the screws 190 through the reinforcing material 180 and the box 160 and into the base 170 wherein the reinforcing material 180 acts like a load dispersing washer for the screws 190, providing reinforcement and strength to the bond between the screws 190, the box 160 and the base 170.

The system of the present invention allows for a safe method to open the container 150 by simply unscrewing the screws 190. The system of the present invention also allows for resealing the container 150 for reshipment by refastening the screws 190 through the reinforcing material 180 and the box 160 and into the base 170 providing a secured container 150 which can withstand shipment conditions. The present invention solves the problem of securing a corrugated shipping container to a pallet without potential for injury when opened and which can be easily and securely resealed.

The description of the invention set forth herein is illustrative and is not intended to limit the scope of the invention as set forth in the following claims. Variations and modifications of the embodiments disclosed herein may be made based on the description set forth herein, without departing from the scope and spirit of the invention as set forth in the following claims.

What is claimed is:

1. A container for packaging and shipping articles, said container comprising:

a substantially rectangular wooden base;

a corrugated box, wherein said box telescopes over the base and wherein a portion of the base is inside the box;

a reinforcing material applied to a section of the outside walls of the box adjacent to the base; and a plurality of fasteners fastening the box to the base through the reinforcing material, wherein the reinforcing material provides reinforcement to the bond between the fasteners, the box and the base.

2. A container, as recited in claim 1, wherein said reinforcing material is fiberboard.

3. A container, as recited in claim 1, wherein said reinforcing material is a foam plastic.

4. A container, as recited in claim 1, wherein said reinforcing material is approximately ⅛ inch thick.

5. A container, as recited in claim 1, wherein said fasteners are self-tapping wood screws.

6. A method for securing a corrugated box to a substantially rectangular wooden base for packaging and shipping articles, said method comprising the steps of:

telescopicly sliding the corrugated box over the base wherein a portion of the base is inside the box;

applying a reinforcing material to a section of the outside walls of the box adjacent to the base; and attaching the box to the base by fastening a plurality of fasteners through the reinforcing material and the box and into the base wherein the reinforcing material provides reinforcement to the bond between the fasteners, the box and the base.

7. A method, as recited in claim 6, wherein said reinforcing material is fiberboard.

8. A method, as recited in claim 7, wherein said reinforcing material is applied with a hot glue.

9. A method, as recited in claim 6, wherein said reinforcing material is a foam plastic.

10. A method, as recited in claim 9, wherein said reinforcing material is applied with a hot glue.

11. A method, as recited in claim 6, wherein said reinforcing material is approximately ⅛ inch thick.

12. A method, as recited in claim 6, wherein said fasteners are self-tapping wood screws.

* * * * *